United States Patent [19]

Schaaf et al.

[11] 4,367,977

[45] Jan. 11, 1983

[54] SHORE EROSION PREVENTION MODULES

[76] Inventors: Cecil F. Schaaf; Craig R. Schaaf, both of 3015 Palmer Rd., Standish, Mich. 48658

[21] Appl. No.: 206,144

[22] Filed: Nov. 12, 1980

[51] Int. Cl.[3] ..... E02B 3/04

[52] U.S. Cl. ..... 405/25; 405/27

[58] Field of Search ..... 405/21, 23, 24, 25, 405/26, 27, 28

[56] References Cited

U.S. PATENT DOCUMENTS

| | | | |
|---|---|---|---|
| 1,748,444 | 2/1930 | Dutton | 405/28 |
| 2,068,537 | 1/1937 | Dorn | 405/28 |
| 2,655,790 | 10/1953 | Daley | 405/28 |
| 3,487,645 | 1/1970 | Frankel | 405/26 |
| 4,027,486 | 6/1977 | Dougherty | 405/27 |

FOREIGN PATENT DOCUMENTS

| | | | |
|---|---|---|---|
| 746025 | 7/1980 | U.S.S.R. | 405/28 |

*Primary Examiner*—David H. Corbin

*Attorney, Agent, or Firm*—Cullen, Sloman, Cantor, Grauer, Scott & Rutherford

[57] ABSTRACT

A series of modules for initiating the creation of a sandbar to halt the erosion of a beach along a body of water. Each module has a heavy concrete base, formed in a ring with a central vertical aperture, which is placed beneath the water near the shore. A series of boards which extend parallel to the shore line are maintained one above the other by a pair of attached flexible belts each of which is also attached to the base at either end. The boards, bound by the belts, form a web which is permitted to drop downwardly during water flow toward the shore line. During water flow from the shore line, the web of spaced boards rises upwardly to form a pocket which is held in a slightly curved position by the belts. The apertured board arrangement retards the water flow sufficiently to cause the deposit of sand onto and adjacent to the base of the module. When arrayed in a row, generally paralleling the shore line, the modules serve in time to create a sandbar and eventually become fully buried.

4 Claims, 7 Drawing Figures

Fig. 4.
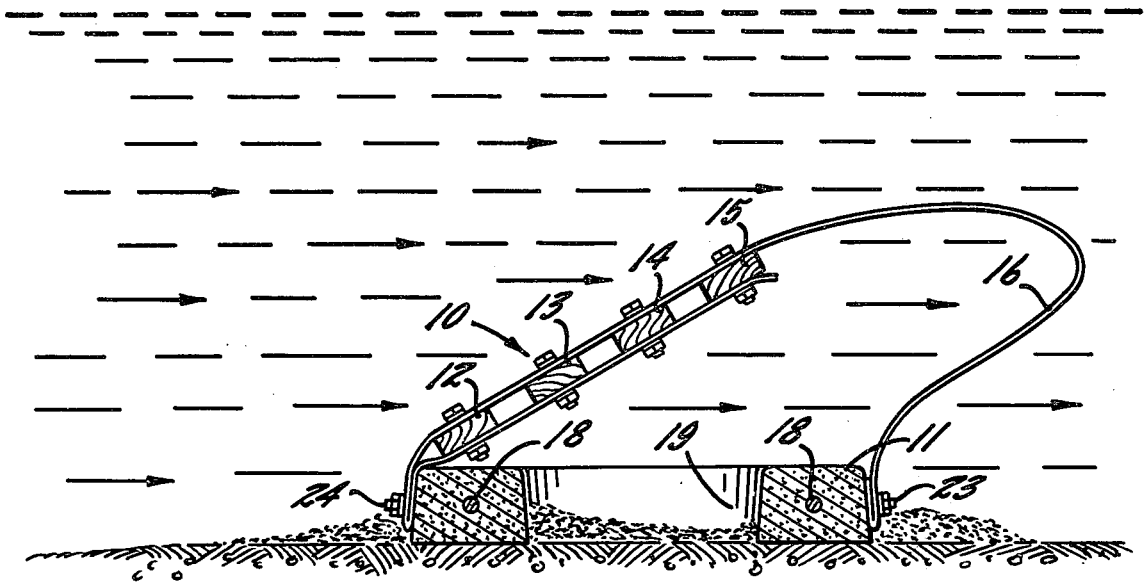
Fig. 5.
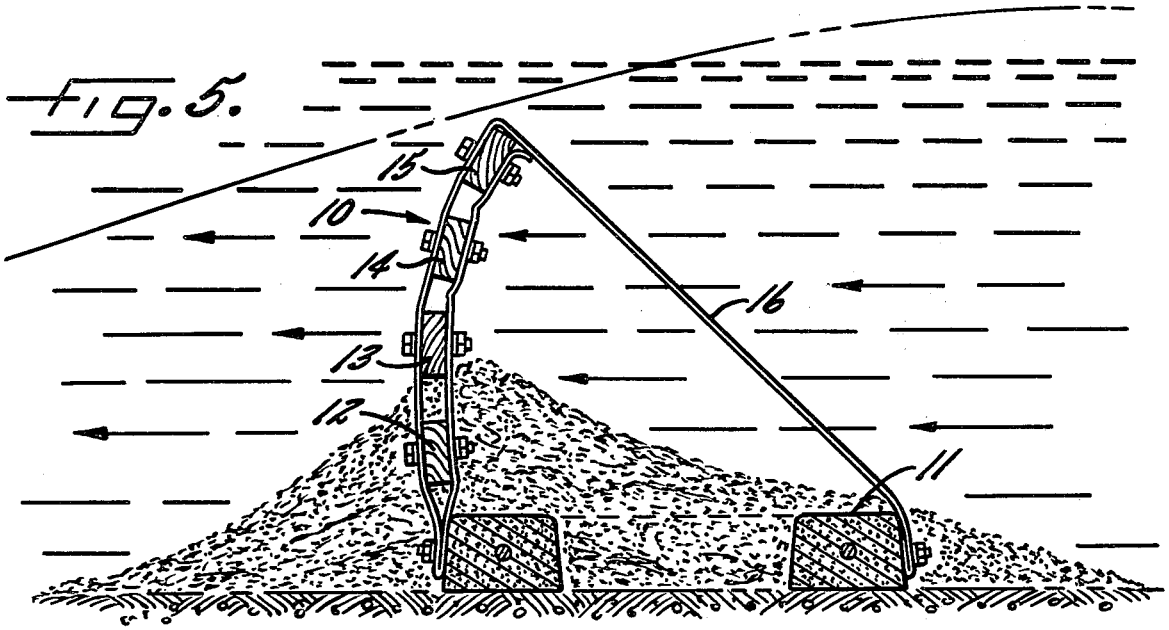
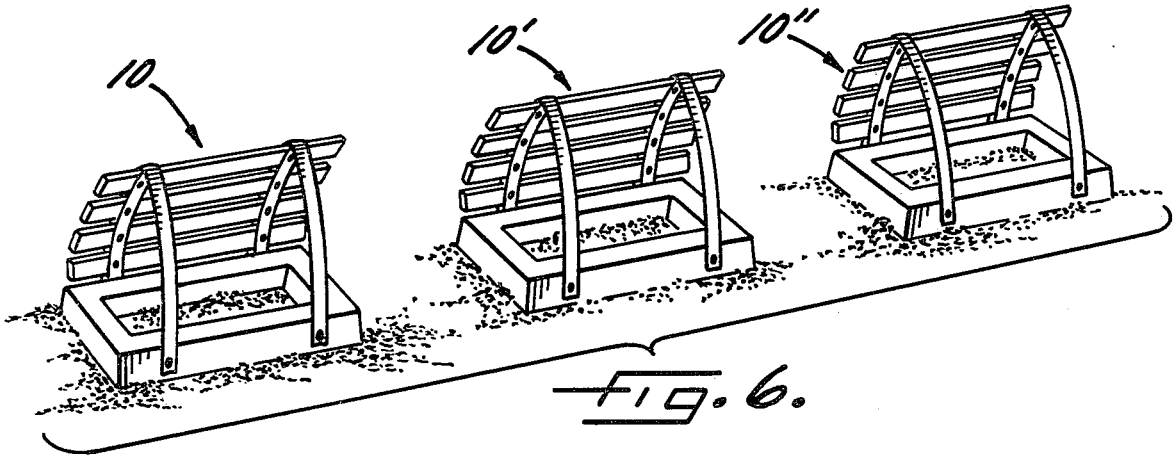
Fig. 6.

SHORE EROSION PREVENTION MODULES

DESCRIPTION OF THE INVENTION

This invention relates generally to shore erosion prevention devices and more particularly concerns such devices which are operable to create an artificial sand bar.

So far as applicants are aware, virtually all shore erosion control devices are fixed devices such as bulk heads, pilings, and barriers of steel or concrete or the like fixed in the water along the shore line. Many, if not most, of such devices are ineffective to actually prevent the erosion of the shoreline. Often they merely redistribute the sand along the shoreline. Further, such rigid devices are hazardous to boats and aesthetically displeasing.

It is consequently an object of the present invention to provide a shore erosion prevention device which is effective while not being a hazard to boating nor detracting aesthetically from the view along the shore line.

It is a further object of the invention to provide such an apparatus which is readily positionable on various below-water contours and whose design enhances its maintenance of a fixed position.

It is a still further object of the invention to provide such an apparatus which is effective to prevent shore erosion and yet does not bear the full destructive force of incoming waves.

Other objects and advantages of the invention will become apparent upon reading the following detailed description and upon reference to the drawings, in which:

FIG. 4 is a side view in section of the module of FIG. 1 shown under water with water flow in the shoreward direction;

FIG. 5 is a view similar to that of FIG. 4 showing a partial sand accumulation and with the water flow in a seaward direction;

FIG. 6 is an array of three modules as they would be positioned in the water adjacent a shoreline in operative use.

Figure 1:
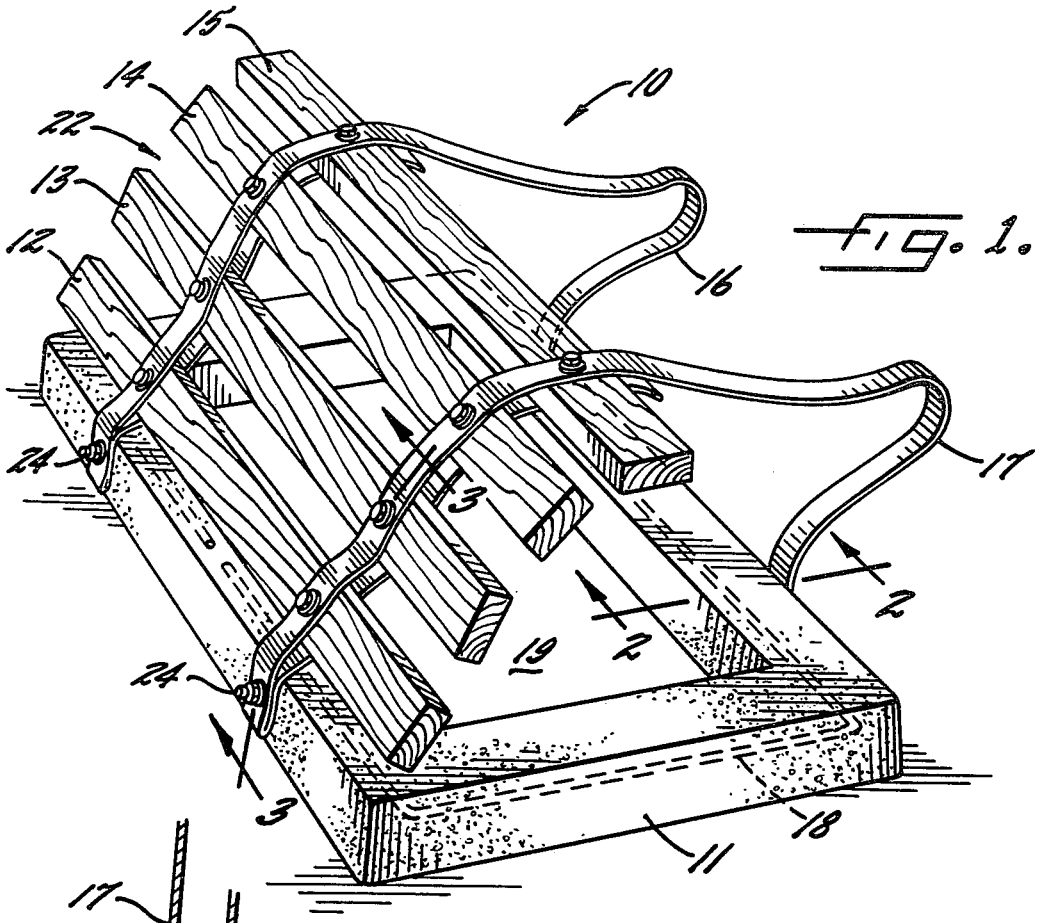
FIG. 1 is a perspective view of a shore erosion prevention module in accordance with the present invention.

While the invention is susceptible to various modifications and alternative forms, specific embodiments thereof have been shown by way of example in the drawings and will herein be described in detail. It should be understood, however, that it is not intended to limit the invention to the particular form disclosed, but, on the contrary, the intention is to cover all modifications, equivalents, and alternatives falling within the spirit and scope of the invention, as defined by the appended claims.

Figure 2:
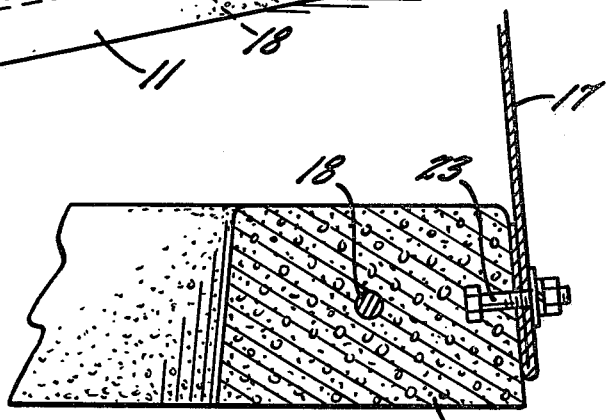
FIG. 2 is a cross-sectional view of a portion of the base of the module of FIG. 1 taken along the line 2—2 and in the direction of the arrows.
Figure 3:
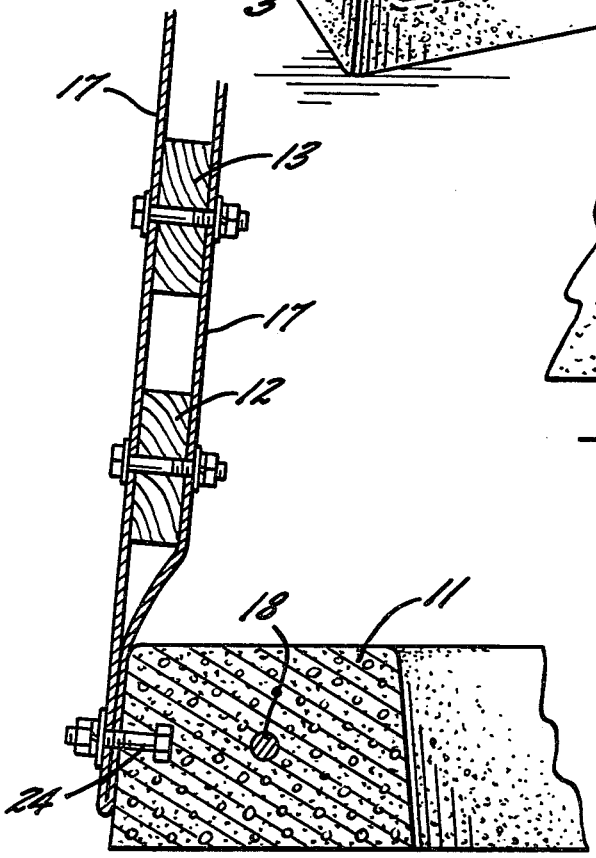
FIG. 3 is a cross-sectional view of a portion of the base and lower slats of the module of FIG. 1 taken along the line 3—3 and in the direction of the arrows.

With initial reference to FIGS. 1,2 and 3, a sand collecting module indicated generally as 10 includes a concrete base 11 and a series of boards 12–15 forming a sand-collecting web held together by belts 16 and 17.

As shall be discussed hereinafter, the web of boards is substantially buoyant in still water and is positioned such that shoreward water flow, from left to right in FIG. 1, pushes the boards downwardly with the water substantially passing over the module 10. Subsequent seaward water flow causes the boards to rise upwardly forming a web generally in the shape of a pocket which is maintained by the belts 16 and 17.

In order to lodge the module in position beneath the water along a shoreline, the base 11 is substantially heavier than water, preferably of a concrete material having a central steel reinforcing bar 18. The weight of the base enables it to serve as ballast for the module 10. The base may alternatively be formed of steel or other rigid, heavy material. A ring-shaped base is preferred to a solid base in order to more readily anchor the module on uneven underwater terrain. The shape of the base 11 as shown in FIG. 1 permits the base to settle into and hold onto irregular terrain such as rocks or the like.

The illustrated form of the base is further advantageous in enhancing the settling of the module into underwater sand upon which it is placed. The central opening 19 in the base rapidly collects sand after the module has been installed due to the suction created by the water flow over the opening 19. The water flow over the opening tends to pull sand upwardly and from beneath the base 11 so that the base quickly settles.

Figure 7:
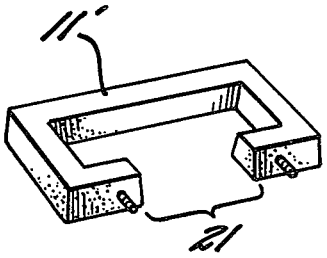
FIG. 7 is an illustration of an alternative base configuration for the module.

Various shapes for the base 11 exhibiting the above-defined advantages are possible, with one alternative form being shown in FIG. 7. The base 11' shown in FIG. 7 includes a seawardly facing opening 21, which would not significantly affect the ballast function of the base 11' and yet would reduce the amount of material needed for construction. The above-mentioned suction effect would also draw sand from beneath the base 11' into the partially defined opening in the base.

In order to trap sand carried by the water flowing seawardly, the boards 12–15 are arranged in a spaced-apart arrangement leaving openings 22 between the boards so as to retard the water flow. The exact spacing of the boards is determined by the wave energy expected since the water flow is to be retarded sufficiently to cause the collection of sand, but the wave energy obviously cannot be fully absorbed by the module 10.

In order to maintain the boards 12–15 in the desired spaced apart web configuration, each board is attached to the pair of straps or belts 16 and 17. The belts are preferably reinforced rubber conveyor belting or the like, and each belt is securely fastened to all of the boards and to the front and rear faces of the base 11. As shown in more detail in FIGS. 2 and 3, the belt 17, for example, is attached by a nut and lock washer to a bolt 23 cast in the shoreward side of the base 11. Similarly, the belt 17 is attached on the seaward side of the base 11 to a bolt 24 cast in the base 11, also by a means of nut and lock washer. While the exact fastening means is not crucial to the invention, so long as it is effective to maintain the belt in position, it has been found that if a nut and bolt arrangement is used, a lock washer or the like is necessary in order to prevent the working loose of the bolts due to wave action. The belt 16 is attached to the base and boards in exactly the same manner as the belt 17.

It can be seen that a single thickness of each belt such as 17 extends upwardly from the vicinity of its attachment to the base 11 on the shoreward side of the module 10. The belt then passes over the tops of the boards 12–15 and is looped back beneath the boards so that a double thickness of the belt is attached on the seaward side of the base 11.

The two thicknesses of each belt are in substantially parallel alignment extending over both sides of the boards, with a suitable fastener passing through each board and both thicknesses of belt to attach each board to the belt. Each fastener may again be a nut, bolt and lock washer arrangement such as is used to attach the belts to the base 11.

While wooden boards 12–15 have been disclosed, other types of slats may be employed such as those constructed of a foam-filled plastic. A significant feature is that the slats or other means form a discontinuous web which is attached to the base 11 and is generally buoyant so as to extend upwardly from the base in the absence of water flow over the module. The web is then free to move downwardly and shorewardly (to the right as shown in FIG. 1) when water flows toward the shore, while during water flow in the opposite, seaward, direction the straps 16 and 17 limit the seaward movement of the upper portion of the web so that water flow through the web is retarded sufficiently to cause the deposit of sand.

FIG. 4 shows one possible configuration for the boards and the belt 16 of the module 10 during water flow toward the shore. Depending upon the energy of the water flow, the web of boards is deflected from a generally vertical orientation to a position inclined more or less toward shore as shown. As can be seen, the boards are free to be deflected to present a lower profile to avoid the full impact of the shoreward flow of the waves. Some initial build up of sand is illustrated in FIG. 4 around the base and within its interior opening 19.

In FIG. 5, the module 10 is illustrated after a more significant buildup of sand, covering the lowermost board 12 and partially covering the next board 13. As can also be seen in FIG. 5, the remaining boards which are free to move in the water are held in a pocket-like configuration by the belts 16 and 17 to retard seaward water flow and continue the collection of sand. The shoreward flow of water, after the accumulation of sand as shown in FIG. 5, results in those boards which remain are free to move being inclined toward the shore.

In FIG. 6 there are shown a series of three sand collection modules 10, 10' and 10'', arranged substantially parallel to the shore line. In practice, a row of modules is placed beneath the water along the shoreline to promote the formation of a sandbar. While there are occasions where a single module may be effective, it is typically preferred to utilize a row of modules, one actual test utilizing modules similar to those described herein in a row of five modules in one location and a row of six modules in a second, adjacent location.

An additional advantage to the present module design is the ability in high wave energy areas to omit one or more of the upper slats until the module has accumulated sand and become securely anchored. The upper slats may then be added either simultaneously or one at a time after the module has become well stabilized. The belts are pre-punched with the appropriate holes so that the slats to be added later may conveniently be added to the belts.

What is claimed is:

1. A barrier module adapted to be submerged in a body of water near a shoreline which is to be protected against wave-induced erosion, comprising:

a base having a specific gravity substantially greater than water and adapted to lie on the bottom of the body of water;

an apertured barrier connected to the seaward side of said base and having buoyant means for normally causing said barrier to extend generally vertically upwardly from said base in a plane parallel to the shoreline when submerged in calm water, flexible strap means connected to the upper edge of said barrier and to the shoreward side of said base to limit the distance which said barrier can be displaced in a seaward direction relative to said base, said barrier being flexible and swingable relative to said base about a horizontal axis parallel to the shoreline and located substantially at the connection of said barrier to the seaward side of said base, under the combined control of water currents and said buoyant means and said strap means;

said apertured barrier yielding shorewardly and downwardly about said connection to the seaward side of said base when subjected to shorewardly directed water flow to present relatively little resistance to said flow, but said strap means controlling the position of said upper edge of said barrier during seawardly directed water flow so that seaward water pressure against said barrier causes said barrier to assume a pocket-like shape which is concave on its shoreward side to thereby create relatively high resistance to seaward water flow to retard such flow sufficiently to cause water borne sand to be deposited in the vicinity of said base.

2. The barrier module of claim 1 in which said apertured barrier comprises a plurality of vertically spaced horizontally extending buoyant slats each connected to second flexible strap means which link said slats together at vertically spaced intervals.

3. A barrier module adapted to be submerged in a body of water near a shoreline which is to be protected against wave-induced erosion, comprising:

a base having a specific gravity substantially greater than water and adapted to lie on the bottom of the body of water;

a plurality of flexible strap means, one end of each strap means being connected to the seaward side of said base and the other end of each strap means being connected to the shoreward side of said base, the length of each strap means intermediate its ends being sufficient to permit said strap to assume a generally inverted Vee configuration with the apex of the Vee being located slightly below the normal surface of the body of water when said strap means is extended to its full upward position and said barrier module is optimally positioned relative to the shoreline to be protected;

a plurality of vertically spaced horizontally extending buoyant slats connected to a first position of said strap means located between said seaward connection of said strap means to said base and said apex, said slats being oriented to extend generally parallel to the shoreline and in a generally vertical plane extending upwardly from said base when submerged in calm water, a second portion of said strap means extending from said apex to said shoreward connection of said strap means to said base being free of any slats, said slats forming a series of vertically spaced buoyant barriers separated by lengths of said flexible strap means, said slats and said first portion of said strap means tending to swing downwardly and shorewardly as a generally planar unit about said seaward connection of said strap means to said base when the module is subjected to shorewardly directed water flows, said swinging movement being slightly resisted by the buoyancy of said slats, which resistance is relatively small so that said slats present relatively little resistance to shorewardly directed water flows, but said second portion of said strap means creating a tension force which limits the movement of the uppermost of said slats in a seaward direction when the module is subjected to seawardly directed water flows, so that said series of slats and said first portion of said strap means tend to assume a pocket-shaped profile which is concave toward the shoreline as permitted by the flexibility of said first portion of said strap means, to thereby create relatively high resistance to seawardly directed water flows to retard such flow sufficiently to cause water borne sand to be deposited in the vicinity of said base.

4. The barrier module of either claim 1 or claim 3 wherein said base is generally ring-shaped in plan view to define a relatively large central opening extending upwardly through the full height of the base, whereby water currents flowing over said base tends to suck sand off the sea bottom from within and around said opening to aid in the settling of said base into the sea bottom.

* * * * *